US008713842B1

(12) United States Patent
Frick

(10) Patent No.: US 8,713,842 B1
(45) Date of Patent: May 6, 2014

(54) FIREARM BARREL PROTECTIVE COVER

(76) Inventor: Jacob O. Frick, Goliad, TX (US)

( * ) Notice: Subject to any disclaimer, the term of this patent is extended or adjusted under 35 U.S.C. 154(b) by 0 days.

(21) Appl. No.: 13/555,865

(22) Filed: Jul. 23, 2012

(51) Int. Cl.
*F41A 35/04* (2006.01)

(52) U.S. Cl.
CPC ..... *F41A 35/04* (2013.01)
USPC ..... 42/96; 42/106

(58) Field of Classification Search
CPC ..... F41A 35/04; F41A 35/02; F41A 17/44; F41A 21/32
USPC ..... 42/96, 106, 1.14; 89/30, 31
See application file for complete search history.

(56) References Cited

U.S. PATENT DOCUMENTS

| | | | | | |
|---|---|---|---|---|---|
| 652,742 | A | * | 7/1900 | Bernstein | 89/31 |
| 1,258,283 | A | * | 3/1918 | Weyand | 42/96 |
| 1,537,517 | A | * | 5/1925 | Wheeling | 42/96 |
| 1,698,646 | A | * | 1/1929 | Methlin | 89/31 |
| 2,385,051 | A | * | 9/1945 | Berlin et al. | 89/31 |
| 2,545,473 | A | * | 3/1951 | Kremkau | 42/96 |
| 2,558,792 | A | * | 7/1951 | Snowden | 42/96 |
| 3,063,184 | A | * | 11/1962 | Sukala, Jr. | 42/96 |
| 3,354,569 | A | * | 11/1967 | Kassabian | 42/96 |
| 4,084,340 | A | * | 4/1978 | Scudder | 42/96 |
| D271,126 | S | * | 10/1983 | Doak | D22/108 |
| 4,817,322 | A | | 4/1989 | Dietz et al. | |
| 4,908,971 | A | * | 3/1990 | Chaney | 42/70.11 |
| 5,105,571 | A | | 4/1992 | Kinchin et al. | |
| 6,516,550 | B1 | * | 2/2003 | Schnyder et al. | 42/96 |
| 7,234,264 | B2 | * | 6/2007 | Cole | 42/96 |
| 7,757,421 | B1 | | 7/2010 | Tompkins et al. | |
| 7,954,412 | B2 | | 6/2011 | Jansson | |
| 7,963,063 | B2 | * | 6/2011 | Camarillo | 42/96 |
| 2011/0000122 | A1 | * | 1/2011 | Camarillo | 42/96 |

OTHER PUBLICATIONS http://www.ima-usa.com/german-mauser-muzzle-cover-ww2-unmarked.html (International Military Antiques; Jul. 11, 2013) Showing a muzzle cover dated back to WWII.*

* cited by examiner

*Primary Examiner* — Bret Hayes
*Assistant Examiner* — Joshua Freeman
(74) *Attorney, Agent, or Firm* — Crossley Patent Law; Micah C. Gunn

(57) ABSTRACT

A firearm barrel protective cover to prevent outside elements from entering a firearm barrel including a convex body partially surrounding the barrel end, the body having an outer wall, an opening disposed between first and second outer ends of the outer wall to accommodate a site member therethrough, and a channel disposed longitudinally within the wall. A disc-shaped flap is disposed abuttingly against a front end of the flap; and a continuous outside wall disposed between the forward end and the rearward end. An attachment member, including a hinge, pivotally attaches the flap to the body to allow gravity to swing and pivot the flap outwardly and downwardly away from the end of the barrel.

2 Claims, 3 Drawing Sheets

FIREARM BARREL PROTECTIVE COVER

BACKGROUND OF THE INVENTION

Various types of muzzle covers for firearms are known in the prior art. However, what is needed is a firearm barrel protective cover that includes a flap that pivots downwardly and away from an end of a firearm barrel when the firearm is pointed downwardly.

FIELD OF THE INVENTION

The present invention relates to firearm muzzle covers, and more particularly, to a firearm barrel protective cover.

SUMMARY OF THE INVENTION

The general purpose of the present firearm barrel protective cover, described subsequently in greater detail, is to provide a firearm barrel protective cover which has many novel features that result in a firearm barrel protective cover which is not anticipated, rendered obvious, suggested, or even implied by prior art, either alone or in combination thereof.

To accomplish this, the present firearm barrel protective cover includes a convex body configured to partially surround an end of a barrel of a firearm. The body includes an outer wall having an first outer end, a second outer end opposite the first outer end, a front end, and a rear end. An opening is disposed between the first and second outer ends. A channel is continuously disposed longitudinally within the wall between the first and second outer ends, the front end, and the rear end. The opening is configured to receive a site member of the firearm barrel therethrough between the first and second outer ends of the outer wall.

A disc-shaped flap is disposed on the front end. The flap has a forward end; a rearward end disposed abuttingly against the front end of the body outer wall; and a continuous outside wall disposed between the forward end and the rearward end.

An attachment member attaches the flap to the body. The attachment member pivotally attaches the flap to the body. The attachment member is a hinge that has a first side centrally disposed on the outer wall of the body and a second side centrally disposed on the outside wall of the flap. The hinge is configured to pivot the flap outwardly and downwardly from the front end of the body. The flap has a diameter slightly greater than a diameter of the body.

The flap prevents outside elements, such as rain, snow, sleet, and dust, from entering the barrel of a firearm. By pointing the barrel downwardly, the hinge allows gravity to swing and pivot the flap outwardly and downwardly away from the end of the barrel.

The hinge allows the cap to naturally fall forwardly and downwardly away from the end of the barrel due to normal gravity, while remaining attached to the barrel for continued use.

The present device prevents outside elements, such as rain, snow, dust, and sleet, from entering a barrel of a firearm thereby promoting safe use of the firearm while providing the capability of quickly discharging the firearm as desired.

The present device is preferably formed of plastic, Teflon, or polymers, such as polystyrene or polyethylene.

Thus has been broadly outlined the more important features of the present firearm barrel protective cover so that the detailed description thereof that follows may be better understood and in order that the present contribution to the art may be better appreciated.

BRIEF DESCRIPTION OF THE DRAWINGS FIGURES

DETAILED DESCRIPTION OF THE DRAWINGS

Figure 1:
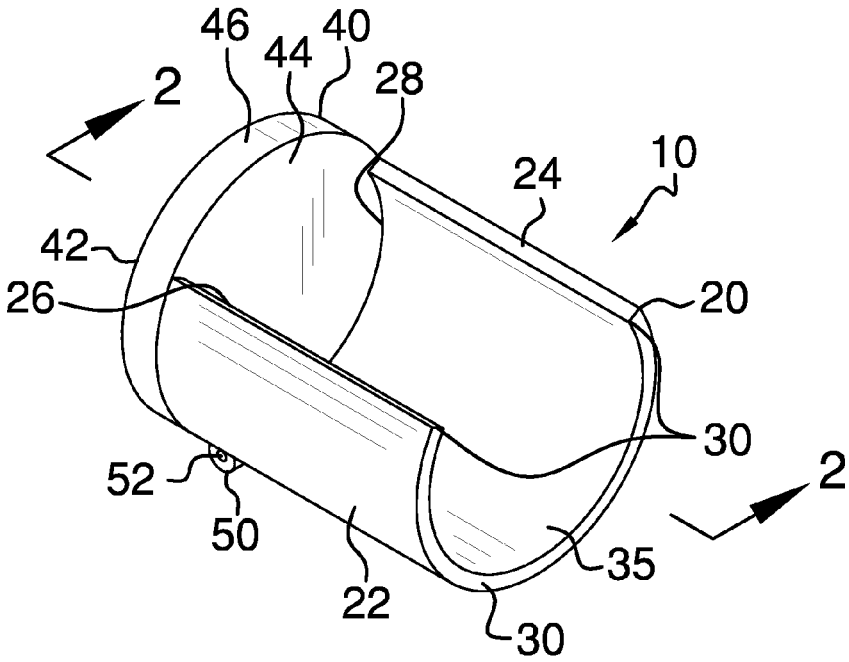
FIG. 1 is an isometric view with a flap in a closed position.
Figure 2:
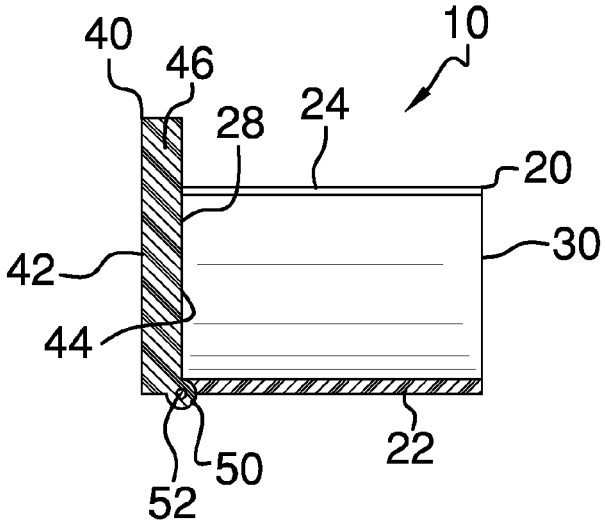
FIG. 2 is a cross-sectional view taken along line 2-2 of FIG. 1.
Figure 3:
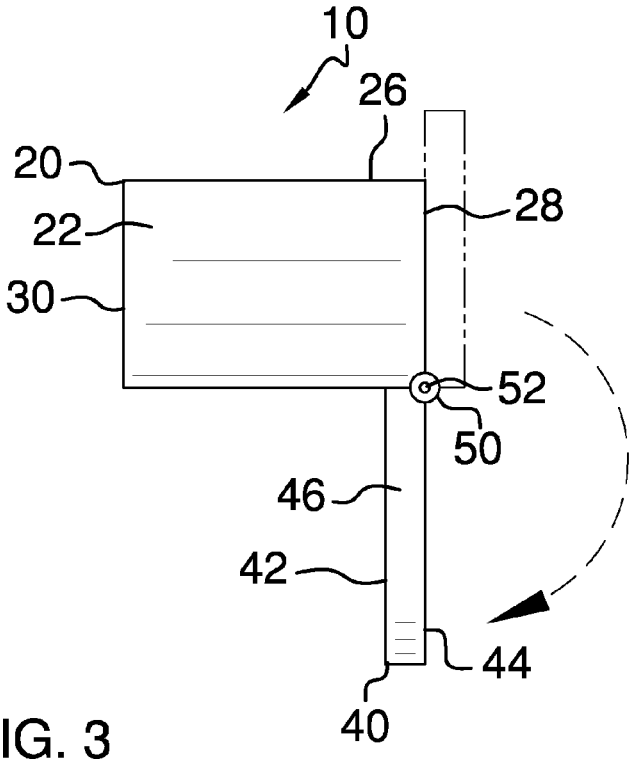
FIG. 3 is a side elevation view with the flap in an open position.
Figure 4:
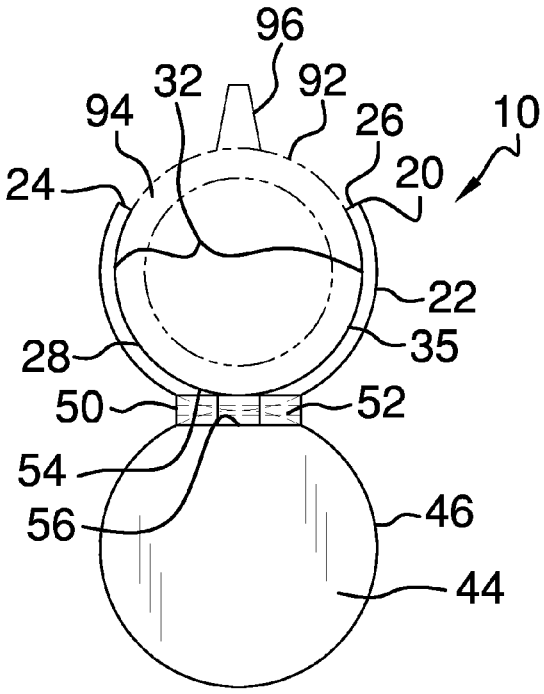
FIG. 4 is a front elevation view with the flap in the open position.
Figure 5:
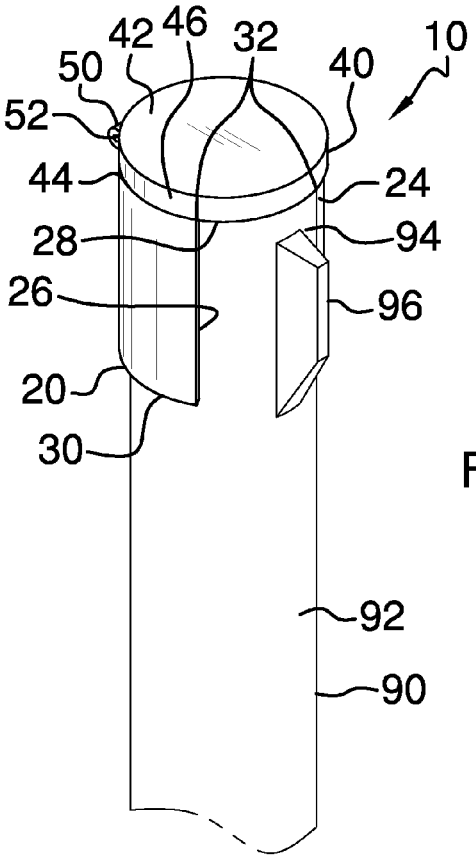
FIG. 5 is an in-use isometric view attached to an outer end of a firearm barrel.
Figure 6:
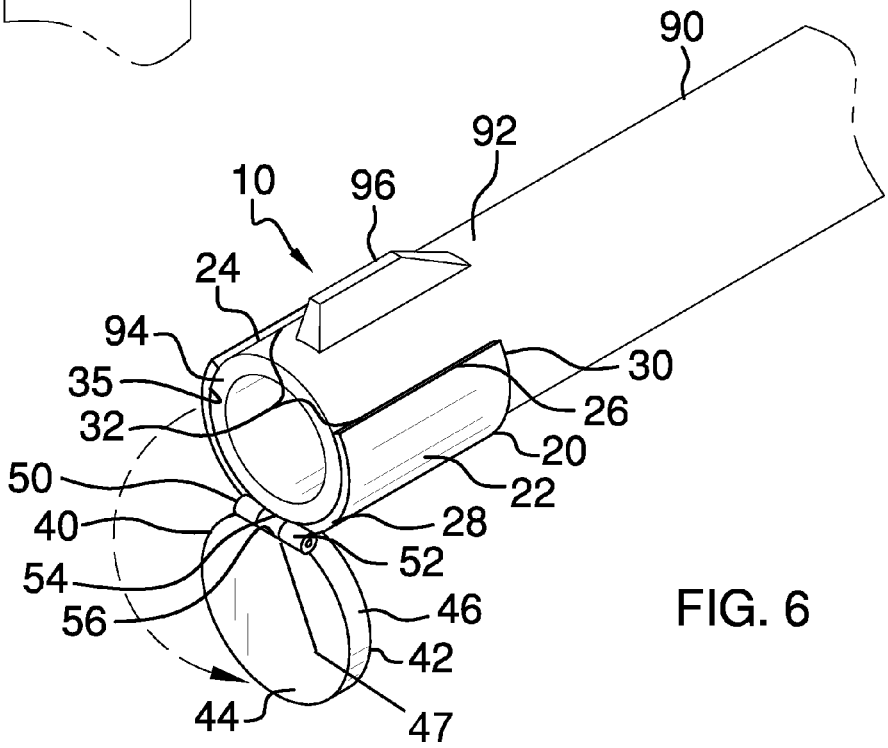
FIG. 6 is an isometric view with the flap in an open position.

With reference now to the drawings, and in particular FIGS. 1 through 6 thereof, example of the instant firearm barrel protective cover employing the principles and concepts of the present firearm barrel protective cover and generally designated by the reference number 10 will be described.

Referring to FIGS. 1 through 6 a preferred embodiment of the present firearm barrel protective cover 10 is illustrated. The firearm barrel protective cover 10 includes a convex body 20 configured to partially surround an end 94 of a barrel 92 of a firearm 90. The body 20 includes an outer wall 22 having an first outer end 24, a second outer end 26 opposite the first outer end 24, a front end 28, and a rear end 30. An opening 32 is disposed between the first and second outer ends 24, 26. A channel 35 is continuously disposed longitudinally within the outer wall 22 between the first and second outer ends 24, 26, the front end 28, and the rear end 30. The opening 32 is configured to receive a site member 96 on the firearm 90 barrel 92 therethrough between the first and second outer ends 24, 26 of the outer wall 22.

A disc-shaped flap 40 is disposed on the entire front end 28. The flap 40 has a forward end 42, a rearward end 44 disposed abuttingly against the front end 28 of the body 20 outer wall 22, and a continuous outside wall 46 disposed between the forward end 42 and the rearward end 44. The flap 40 also has a bottom end 47.

An attachment member 50 attaches the flap 40 to the body 20. The attachment member 50 pivotally attaches the flap 40 to the body 20. The attachment member 50 is a hinge 52 that has a first side 54 centrally disposed on the outer wall 22 front end 28 of the body 20 and a second side 56 centrally disposed on the outside wall 46 and the bottom end 47 of the flap 40. The hinge 52 is configured to pivot the flap 40 outwardly and downwardly, away from the front end 28 of the body 20. The flap 40 has a diameter slightly greater than a diameter of the body 20.

The flap 40 prevents outside elements, such as rain, snow, sleet, and dust, from entering the barrel 92 of the firearm 90. By pointing the barrel 92 downwardly, the hinge 52 allows gravity to swing and pivot the flap 40 outwardly and downwardly away from the end 94 of the barrel 92.

What is claimed is:

1. A firearm barrel protective cover comprising:

a convex body configured to partially surround only a portion of an end of a barrel of a firearm, the body comprising:

an outer wall having an first outer end, a second outer end opposite the first outer end, a front end, and a rear end;

an opening disposed between the first and second outer ends;

a channel continuously disposed longitudinally within the wall between the first and second outer ends, the front end, and the rear end;

a disc-shaped flap disposed on the entire front end, the flap comprising:

a forward end;

a rearward end disposed abuttingly against the front end of the body outer wall;

a continuous outside wall disposed between the forward end and the rearward end;

a bottom end;

a hinge having a first side centrally disposed on the body outer wall front end and a second side centrally disposed on the outside wall and bottom end of the flap;

wherein the hinge is configured to pivot the flap outwardly and downwardly from the front end of the body;

wherein the opening is configured to receive a site member of the firearm barrel therethrough between the first and second outer ends of the outer wall.

2. The firearm barrel protective cover of claim 1 wherein the flap has a diameter slightly greater than a diameter of the body.

* * * * *